US006935770B2

(12) United States Patent
Schueler

(10) Patent No.: US 6,935,770 B2
(45) Date of Patent: Aug. 30, 2005

(54) CAVITATION MIXER

(75) Inventor: Rolf Schueler, Worth (DE)

(73) Assignee: Manfred Lorenz Locher, Munderkingen (DE)

( * ) Notice: Subject to any disclaimer, the term of this patent is extended or adjusted under 35 U.S.C. 154(b) by 55 days.

(21) Appl. No.: 10/220,097

(22) PCT Filed: Feb. 28, 2001

(86) PCT No.: PCT/EP01/02253

§ 371 (c)(1),
(2), (4) Date: Dec. 30, 2002

(87) PCT Pub. No.: WO01/62373

PCT Pub. Date: Aug. 30, 2001

(65) Prior Publication Data

US 2003/0147303 A1 Aug. 7, 2003

(30) Foreign Application Priority Data

Feb. 28, 2000 (DE) ..... 100 09 326

(51) Int. Cl.[7] ..... B01F 5/08
(52) U.S. Cl. ..... 366/174.1; 366/176.2
(58) Field of Search ..... 366/167.1, 174.1, 366/175.2, 176.1, 176.2, 182.1, 336–338; 138/37, 40, 42–43, 46

(56) References Cited

U.S. PATENT DOCUMENTS 3,473,787 A * 10/1969 Bartlett ..... 366/176.2
3,834,982 A * 9/1974 Alexandrovich et al.
4,127,332 A * 11/1978 Thiruvengadam et al. ..... 366/176.1
4,299,655 A * 11/1981 Skaugen ..... 366/336
5,492,654 A * 2/1996 Kozjuk et al. ..... 366/336
5,810,052 A * 9/1998 Kozyuk ..... 138/37
5,937,906 A * 8/1999 Kozyuk ..... 138/37
5,971,601 A * 10/1999 Kozyuk ..... 366/176.1
6,035,897 A * 3/2000 Kozyuk ..... 138/37
6,502,979 B1 * 1/2003 Kozyuk ..... 366/176.2
6,802,639 B2 * 10/2004 Kozyuk ..... 366/176.2
2004/0071044 A1 * 4/2004 Kozyuk ..... 366/176.2

FOREIGN PATENT DOCUMENTS

WO 96/09112 * 3/1996

* cited by examiner

*Primary Examiner*—Charles E. Cooley
(74) *Attorney, Agent, or Firm*—Blakely Sokoloff Taylor & Zafman

(57) ABSTRACT

A device for mixing the components of a mass flow flowing through it, provides a particularly homogeneous mixture with any desired long-term stability, even if components which are generally immiscible or can only be mixed with very great difficulty are being mixed. The device has a body (8), which it is difficult for medium to flow around, arranged in a through-flow chamber (4), this body being arranged at least partially in a part of the through-flow chamber (4) which widens in the direction of flow, so that the cavitation action and mixing action of the supercavitation field generated by the body (8) which it is difficult for medium to flow around is significantly reinforced.

26 Claims, 8 Drawing Sheets

200

CAVITATION MIXER

BACKGROUND OF THE INVENTION

1. Field of the Invention

The invention relates to a device for mixing the components of a mass flow flowing through it, in which the components may, in particular, be in solid, liquid or gas form by means of a hydrodynamic supercavitation field, in order to generate a mixture, in particular an emulsion or a suspension.

2. Description of Related Art

If what is known as the static pressure in a liquid flowing in, as a result of a flow constriction, locally falls below the vapor pressure, cavitation occurs, i.e. vapor-filled gas bubbles, which are also known as cavitation bubbles, are formed in the liquid. If the static pressure then increases again and exceeds the vapor pressure, these gas bubbles collapse implosively (practically at the speed of sound).

This mechanism of hydrodynamically generated cavitation is covered by the Bernoulli-equation. According to this equation, it is generally the case (cf. "Gerthsen Physik", Helmut Vogel, ISBN 3-540-59278-4, 18th Edition, Springer-Verlag Berlin Heidelberg New York, 1995, Chapter 3.3.6, Strömung idealer Flüssigkeiten [Flow of ideal liquids], pp. 118 to 121) on every potential surface of the external volumetric forces in a filament of flow which flows in, i.e. everywhere at the same height in the case of the force of gravity, that $$p+\tfrac{1}{2}\rho v^2=p_0=\text{const},$$

where $p_0$ is the pressure which would prevail in the stationary liquid, for example air pressure plus the hydrostatic pressure $\rho gh$. The sum of the static pressure p and the dynamic pressure $\tfrac{1}{2}\rho v^2$ has the same value everywhere at a given depth.

When the flow velocity reaches or exceeds the value $v_k=\sqrt{2\rho_0/\rho}$, the static pressure becomes zero or negative. Such velocities (in water $v_k$=14 m/s) are easily reached in all high-speed water-craft, in low-speed water-craft at least at the propellers and also at turbine blades and in liquid pumps. Even slightly beforehand, the static pressure falls below the vapor pressure of the liquid, which is a few hundred Pa, and cavitation occurs, in particular, if microscopic air bubbles are already present as nuclei, which is difficult to avoid.

Therefore, the phenomenon of hydrodynamic cavitation consists in the formation of hollow spaces which are filled with a vapor gas mixture, known as the cavitation bubbles, in the interior of a fast-flowing liquid flow or at peripheral regions of a body which it is difficult for medium to flow around and which is arranged in the flowing liquid flow, in each case as a result of a local pressure drop caused by the liquid movement (flow). Therefore, hydrodynamic cavitation occurs in all hydraulic systems in which considerable pressure differences occur, such as turbines, pumps and high-pressure nozzles.

In the case of ultrasonic cavitation, in the sub-atmospheric pressure phase of a sound field the tearing stresses of the material are exceeded, so that once again the cavitation bubbles filled with vapor or gas are formed. In sonochemisrtry, the extreme conditions which occur on collapse (pressure, temperature) of the cavitational bubbles generated in the ultrasound field are exploited. The physical effect of sonoluminescence is also associated with the dynamics of cavitation bubbles and their generation by means of an ultrasound field.

The examples mentioned above relate to cavitation which occurs in the flow field or in the acoustic field as a result of a tensile stress which is present in the water or a liquid. Generating a further type of cavitation involves locally depositing energy in the liquid, for example by means of a spark or a laser pulse. Details of the latter are to be found, for example in the thesis written by Olgert Lindau, "Dynamik und Lumineszenz lasererzeugter Kavitationsblasen", [Dynamics and luminescence of laser-generated cavitation bubbles], 1998, written at the Third Physics Institute of the Georg-August-Universität in Göttingen.

It is known that cavitation and the associated effects can be used to mix the components of a flowing mass flow. Therefore, by way of example, two different liquids or a liquid and a solid (particles) or a liquid and a gas can be mixed with one another. The mixing, emulsifying and dispersing action of the cavitation is based on the action of a large number of forces originating from collapsing cavitation bubbles on the mixture of components which is to be treated. The implosion of cavitation bubbles in the vicinity of the interface between two solid-liquid phase regions is accompanied by the dispersion of the solid phase (particles) in the liquid phase (liquid) and by the formation of a suspension. Similarly, the implosion of cavitation bubbles in the vicinity of the interface between two different liquid phases is accompanied by one liquid being broken up in the other and the formation of an emulsion. In both cases, the interface between the continuous phases is destroyed, i.e. eroded, and a dispersion medium and a disperse phase are formed.

U.S. Pat. No. 3,834,982 has described a device for generating a suspension of fiber materials. The device comprises a housing having an entry opening for supplying components of a fiber-material suspension and an exit opening for removing the fiber-material suspension produced by cavitation, and a through-flow chamber with a cylindrical body, which comprises a single piece and is difficult for medium to flow around (and which is generally also known as a cavitator on account of its function), placed therein. The component flow flows through the through-flow chamber and the cylindrical body, which it is difficult for medium to flow around, positioned therein, which body is arranged transversely with respect to the direction of flow, so that it generates local narrowing of the fiber-material suspension. Therefore, a hydrodynamic cavitation field is formed behind the cylinder, i.e. the cylinder generates a three-dimensional region in the flowing mass flow in which, in a dynamic process, cavitation bubbles are formed, are present and collapse (implode).

On account of the shape of the one cylindrical body which it is difficult for medium to flow around in U.S. Pat. No. 3,834,982, only a single cavitation field is formed behind this body as a result of the cross-sectional narrowing of the flow cross section which it produces. Therefore, this device effects only relatively poor mixing of the components of the fiber-material suspension with regard to the homogeneity (particle size) and long-term stability of the dispersion produced. The intensity of the cavitation field produced using the device described in U.S. Pat. No. 3,834,982 is too low for mixing or dispersing phases which are difficult to mix or disperse.

The cavitation mixer described in SU-A 1088782) additionally has a means which allows further pressure oscillations generated by means of a compressed-air source to be superimposed on the cavitation field.

The cavitation mixer disclosed in SU-A 1678426 has an axially elastically mounted body which it is difficult for medium to flow around and which is intended to cause its own resonant vibrations in the liquid medium.

SU-A 1720695 has described a further cavitation mixer which, as the body which it is difficult for medium to flow around, has two hemispheres which between them delimit a rectangular groove. The pulsation of the flow in the groove is intended to act on the cavitation region and in this way to increase the frequency of cavitation bubbles and their intensity.

Therefore, the three documents cited above disclose cavitation mixers in which the mixing effect is to be improved by attempting to improve the cavitation action by means of further separation edges or by superimposing pressure waves which correspond to further separation edges.

DE-A-3610744 has described a device for the direct aeration and recirculation in particular of waste waters, which uses an impeller to generate a cavitation field and mixes air into water.

U.S. Pat. No. 4,127,332 has disclosed a further mixing device which uses cavitation for this purpose.

Compared to the cavitation mixes described above, in which in each case only one cavitation field is generated, in order to mix two different components of a system, the cavitation effect and therefore the mixing effect is significantly improved in cavitation mixers which generate what is known as a super-cavitation field, i.e. one which superimposes a plurality of cavitation fields.

For example, DE-A 4433744 has disclosed a cavitation mixer which, as the body which it is difficult for medium to flow around (cavitator), has a truncated cone which is formed from a plurality of partial bodies which it is difficult for medium to flow around and between each which there is a hollow space through which medium can flow. This body around which it is difficult for medium to flow is arranged in a fixed position in a passage chamber which—as seen in the direction of flow—has a constant circular cross section throughout the whole of the body which it is difficult to flow around.

A first cavitation field is generated in a customary way as a result of medium flowing around the entire body. Furthermore, the hollow spaces through which medium can flow form a further source for cavitation fields which are formed by the flow in these hollow spaces, which in particular are also directed upwardly into the flows flowing around the body as a whole, so that the cavitation bubbles in the hollow spaces through which medium can flow also merge outward into the conventional cavitation field. The three-dimensional superimposition of the individual cavitation fields generates what is known as a supercavitation field and results in multiplication of the cavitation effect of each individual cavitation field.

Hydrodynamic supercavitation generators as in DE-A 4433744 represent effective mixing devices which can be used to process, for example, mix, emulsify, homogenize, disperse or dissolve, a flowing fluid comprising a plurality of components or to saturate liquids with gases. Supercavitation generators are universal devices for processing a wide range of products in the chemical, petrochemical, cosmetic and pharmaceutical industries and also in the ceramics and foodstuffs industries and in other branches of the economy.

Typical basic technical data for a hydrodynamic supercavitation generator and parameters of the medium to be processed are:

| | |
|---|---|
| Productivity: | 0.1 to 500 $m^3/h$ |
| Admission pressure: | 0.3 to 1.2 MPa |
| Substance viscosity: | 0.001 to 30 Pa · s |
| Substance temperature: | 5 to 250° C. |

-continued

| | |
|---|---|
| Overall length: | 50 to 800 mm |
| Diameter of the working chamber: | 15 to 300 mm |
| Mass: | 0.4 to 40 kg |
| Minimum duration of use: | 30 000 h |

The mixing and homogenization processes in the mixer are based on the use of the hydrodynamic cavitation and are linked with physical effects such as pressure waves, cumulation, self-induced vibrations, vibration turbulence and parallel diffusion, by way of example, which occur when cavitation bubbles collapse. The volumetric concentration of the cavitation bubbles in the equipment reaches orders of magnitude of 1 to $10^{10}$ $1/m^3$. When each cavitation bubble collapses, pressure pulses are initiated, which reach $10^3$ MPa and above, and, as in the implosion of a cavitation bubble, temperatures of around 5000 K occur in the bubble (cf. for example VDI Nachrichten, Apr. 1, 1999, No. 13, "Schadstoffe im Ultraschall" [Harmful substances in ultrasound]). At the high volumetric concentration of the bubbles in the working range of the mixer, such high pressure pulses contribute to the pulsed power fed to a volumetric unit of the medium which is to be processed amounting to $10^4$ to $10^5$ $kW/m^3$. It should also be noted that a vacuum zone with a pressure of 4 to 10 kPa is generated in the working chamber of the mixer, making it possible for various liquid and gaseous components to be injected directly into the mixer.

EP-A 0 644 271 has likewise disclosed a hydrodynamic supercavitation mixer which includes a body which it is difficult for medium to flow around and which comprises at least two elements which ensure the formation of their own cavitation fields. The elements or partial bodies which form the body which it is difficult for medium to flow around may be in the form of hollow truncated cones or hemispheres and moreover may each be secured to a hollow bar. These bars are designed in such a way that they can be fitted into one another and can each be connected to individual devices, so that they can be displaced in the axial direction with respect to one another. In this way, the individual elements which form the body which it is difficult for medium to flow around can be axially displaced with respect to one another in the direction of flow and in this way can be arranged at different distances in relation to one another. In this way, it is possible to vary and adjust not only the shape of the elements but also by means of the distance between the elements, the properties of the hydrodynamic cavitation field produced by each element, which in turn has a corresponding effect on the superimposition of the individual cavitation fields, i.e. the supercavitation field of the cavitation mixer.

EP-A 0 644 271 also teaches that to optimize the processes of dispersion and emulsification it is expedient for a gaseous component to be introduced into the hydrodynamic flow of components at least in a section of its local constriction, or immediately downstream thereof. The elements of the body which it is difficult for medium to flow around may also consist of an elastic, nonmetallic material. Moreover, the cavitation mixer may include a further, additional body which it is difficult for medium to flow around, which, as seen in the direction of flow, is arranged downstream of the first body which it is difficult for medium to flow around and which it resembles, and which is connected to this first body which it is difficult for medium to flow around by an elastic element, in such a manner that it can be displaced along the axis of the through-flow passage.

In addition to the adjustable element of the body which it is difficult for medium to flow around, the process or device described in EP-A 0 644 271 also offers the possibility of regulating the intensity of the hydrodynamic supercavitation field which is formed to match the specific technological process sequences. However, the body which it is difficult for medium to flow around as a whole is arranged at a fixed location in a through-flow passage which, moreover, has a constant circular cross section in the region of the body which it is difficult for medium to flow around and as seen in the direction of flow.

Although the hydrodynamic supercavitation generators according to the prior art generally provide good results, there is nevertheless a need for improvement in many respects.

BRIEF SUMMARY OF THE INVENTION

Therefore, it is an object of the present invention to provide a device for mixing the constituent or components of a mass flow which is flowing through it by means of at least one hydrodynamic supercavitation field, in such a manner that the treated mass flow is extremely homogeneous and also remains so for any desired length of time, even if the device is used to mix components which are usually extremely difficult to mix and which cannot be mixed or can only be mixed with difficulty and/or for a relatively short time using devices in accordance with the prior art.

A further object of the present invention is to provide a device for mixing the constituents or components of a mass flow which is flowing through it by means of at least one hydrodynamic supercavitation field without additional substances (such as additives or emulsifiers) being used, in order to improve the mixing effect or the mixing result or in order simply to obtain a mixture.

A further object of the present invention is to provide a device for mixing the components of a mass flow which is flowing through it, in which the mixing action or mixing results can be adapted in a controlled way to the nature and concentration of the components which are to be mixed, in other words to the properties of the specific system which is to be homogenized in each case and to corresponding process and result parameters.

A further object of the present invention is to provide a device for mixing the components of a mass flow which is flowing through it in which the kinetic energy of the flow is optimally utilized for intimate mixing or homogenization.

A device for mixing the constituents or components of a mass flow which is flowing through it in accordance with the present invention—which is also referred to below as a supercavitation mixer—comprises a housing with at least one entry opening and at least one exit opening. All or part of the mass flow which is to be mixed is introduced into the at least one entry opening, and after it has been acted on by a hydrodynamic supercavitation field, the mass flow is discharged through the at least one exit opening. As essential components, the supercavitation mixer comprises a through-flow chamber, which is part of the housing, and a body which it is difficult for medium to flow around and which is arranged in the through-flow chamber by means of a holder. The body which it is difficult for medium to flow around has at least two subregions which it is difficult for medium to flow around and which are each responsible for local flow constriction in the mass flow flowing through the through-flow chamber in the region of the body which it is difficult for medium to flow around. The cross section of the through-flow chamber, taken perpendicular to its center axis, increases, as seen in the direction of flow of the mass flow flowing through the through-flow chamber, at least in a part of the region of the through-flow chamber which surrounds the body which it is difficult for medium to flow around. This widening part of the through-flow chamber is significant for the generation of the ultra-effective supercavitation field according to the invention.

The subregions which it is difficult for medium to flow around and the body as a whole which it is difficult for medium to flow around are the sources of a plurality of cavitation fields which are superimposed in one another and thereby form a supercavitation field. The supercavitation field provided by the supercavitation mixer in accordance with the present invention is suitable for mixing or homogenizing a very wide variety of components particularly effectively. Therefore, even components which are normally extremely difficult to mix—without further additional substances, such as for example emulsifiers—can be converted into particularly homogeneous mixtures, with extremely good long-term stability, using the supercavitation mixer. If the components are in liquid form, emulsions are obtained, and if one of the components is in liquid form and the other is in solid form, i.e. consists, for example, of particles with a defined size distribution, the result is suspensions in which the particle size is considerably reduced. Furthermore, the supercavitation mixer according to the invention can be used to mix gaseous and liquid components or to dissolve a gaseous component particularly effectively in one or more liquid components.

A few examples of possible mixtures are water-diesel suspensions, the homogenization of foodstuffs or dyes, or the mixing or dissolution of chlorine gas in water.

It will be understood that the constituents or components which are to be mixed do not necessarily each have to have a different atomic or molecular composition. By way of example, two components which are to be mixed may each have the same chemical composition, but one component is in the liquid phase and the other is in the solid phase. It is also possible for two or more components to be mixed each to contain the same chemical constituents, but in different concentrations. In particular, recycling or multiple treatment of a multicomponent mass flow which has already been treated once in the supercavitation mixer according to the invention is also possible, should this be advantageous for process engineering or other reasons.

A further advantageous configuration of the invention consists in coupling a plurality of supercavitation mixers according to the invention, in such a manner that their respective supercavitation fields are superimposed on one another in a common region of a common through-flow chamber, with the result that the mixing effect of the individual supercavitation fields is in turn raised to a higher power. A further advantage of a configuration of this type is that for the same total quantitative flow rate—compared to a correspondingly dimensioned individual supercavitation mixer with a large, powerful pump—in this case only a plurality of small pumps are required, which is much more effective in terms of process engineering.

According to one advantageous configuration of the invention, the body of the supercavitation mixer which it is difficult for medium to flow around can be displaced axially along the direction of the center axis of the through-flow chamber. As a result, it is possible for the body which it is difficult for medium to flow around to deliberately be positioned in the at least one widening region of the through-flow chamber in such a way that an optimum cavitation effect or an optimum supercavitation field is provided according to the type of components which are to be mixed, so that optimally homogeneous mixing with long-term stability can be achieved. It will be understood that further process parameters or result parameters can also be set or controlled in this way.

A further advantageous configuration of the invention consists in the partial body which it is difficult for medium to flow around comprising a multiplicity of individual partial bodies which it is difficult for medium to flow around (and which correspond to the subregions which it is difficult for medium to flow around) and which are connected to one another and arranged in such a way that all of them or only some of them or only one of them can be displaced independently of one another along the direction of the center axis of the through-flow chamber. This allows the supercavitation field and therefore the mixing action of the supercavitation mixer likewise to be regulated in such a way that desired properties of the multicomponent mass flow, such as homogeneity and stability, can be regulated optimally according to the process parameters and the type of components which are to be mixed.

According to a further advantageous configuration of the invention, at least one of the subregions or partial bodies, which it is difficult for medium to flow around, of the body which it is difficult for medium to flow around is designed in such a way that its cross section, taken perpendicular to the center axis of the through-flow chamber, is smaller at the end of the subregion or partial body which faces the entry opening of the housing than at the end which faces the exit opening of the housing.

According to a further advantageous configurations of the invention, the through-flow chamber of the supercavitation mixer has a bulge in its wall which, by way of example, is formed in a bead-like protuberance around the length of its circumference. This bulge may be arranged at a suitable location with respect to the body which it is difficult for medium to flow around, in such a manner that the supercavitation field is influenced in a controlled way and its mixing action is optimized. It is evident that, if the body which it is difficult for medium to flow around can be displaced along the direction of the center axis of the through-flow chamber, even if this in some cases only applies to a partial body thereof, the mixing action of the supercavitation field, in combination with this bulge, can be adjusted particularly well to the type of components which are to be mixed and further process parameters and can be optimized.

According to a further advantageous configuration of the invention, the body which it is difficult for medium to flow around consists at least in part of an elastic, nonmetallic material or has a corresponding covering. This inherently prevents the cavitation fields from having any disruptive effect on the equipment.

According to a further advantageous configuration of the invention, part of the mass flow which is to be mixed or a certain component thereof can be introduced directly into the through-flow chamber via a correspondingly designed holder and a correspondingly designed body which it is difficult for medium to flow around, in each case having corresponding hollow spaces which pass all the way through. In this way, the supercavitation field or its mixing action can once again be influenced in a controlled way, in particular according to the type of components which are to be mixed, in such a manner that an optimum mixing action is achieved.

According to a further advantageous configuration of the invention, both the body which it is difficult for medium to flow around and the mass flow in the through-flow chamber can be acted on by ultrasound. By way of example, this allows the body which it is difficult for medium to flow around to be set in vibration, which can intensify the formation of the cavitation fields and/or the mixing action thereof. Accordingly, applying ultrasound to the mass flow makes it possible to effect additional ultrasound cavitation and to intensify the cavitation fields which have already been generated by the body which it is difficult for medium to flow around itself and/or the mixing action thereof.

Corresponding effects can also be obtained, if, according to a further advantageous configuration of the invention, the body which it is difficult for medium to flow around directly and/or a part of the through-flow chamber or the whole of the through-flow chamber is set in ultrasonic vibration.

In this context, the term intensifying the mixing effect or the cavitation fields is also understood as meaning any modification to the properties of the cavitation fields (for example the size distribution of the cavitation bubbles, their three-dimensional distribution or their potential energy before they implode) which contributes to the mass flow which is to be mixed having better or specifically desired properties after the treatment.

In this context, according to a further advantageous configuration of the invention, the mass flow flowing through the through-flow chamber can also accordingly be acted on by laser light of a suitable intensity and/or wavelength in a corresponding or a plurality of corresponding three-dimensional regions.

BRIEF DESCRIPTION OF THE DRAWINGS

Further details and advantages of the invention will emerge from the following description of the preferred embodiment of the invention with reference to the drawing, in which.

DETAILED DESCRIPTION OF THE INVENTION

In each of the figures, the reference number 100 denotes a device for mixing the components of a mass flow which is flowing through it by means of a hydrodynamic supercavitation field, i.e. a superimposition of a plurality of cavitation fields. This inventive device is also referred to below as a supercavitation mixer 100.

Figure 1A:
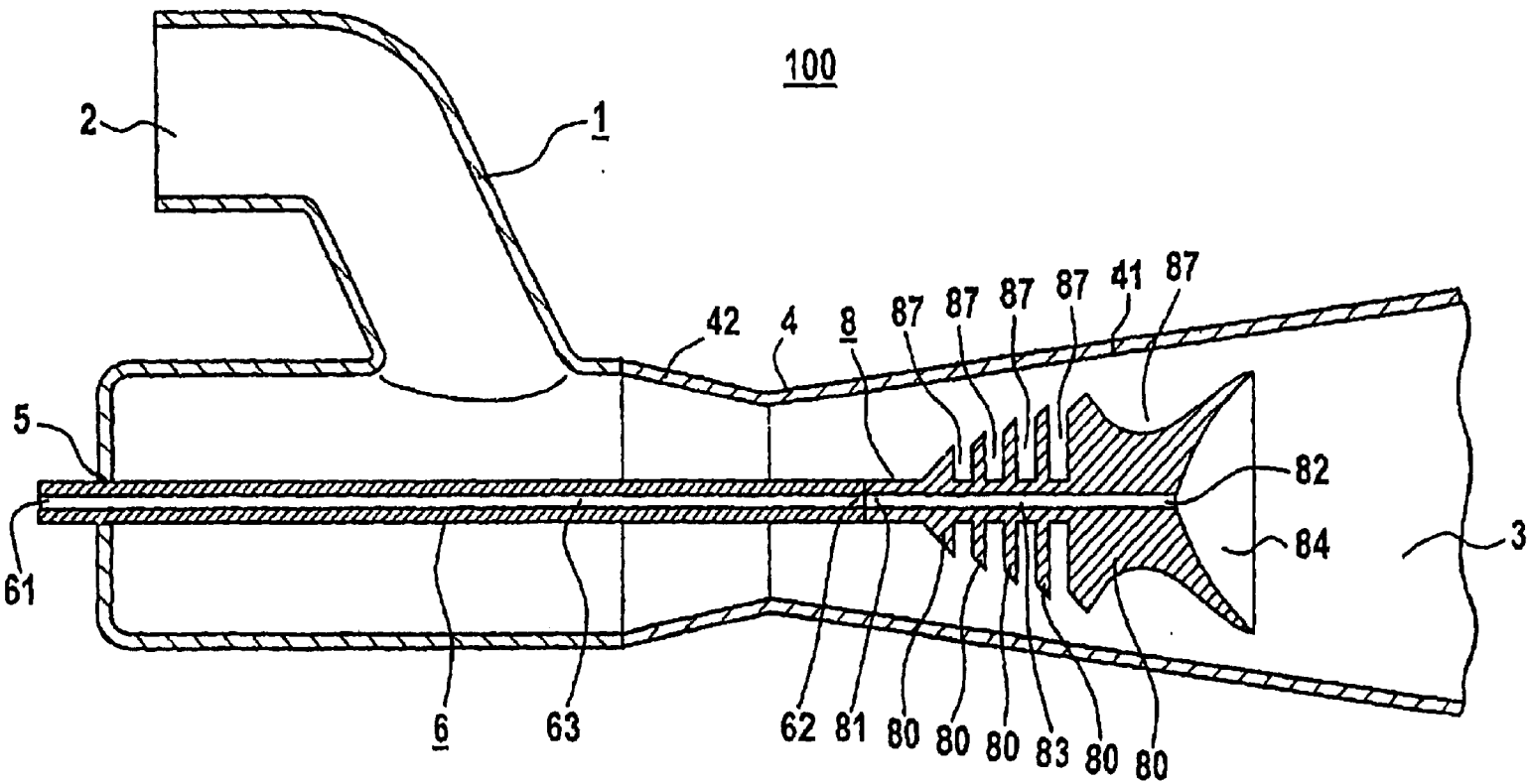
FIG. 1*a* shows a diagrammatic cross-sectional view of a first exemplary embodiment of the invention.
Figure 1B:
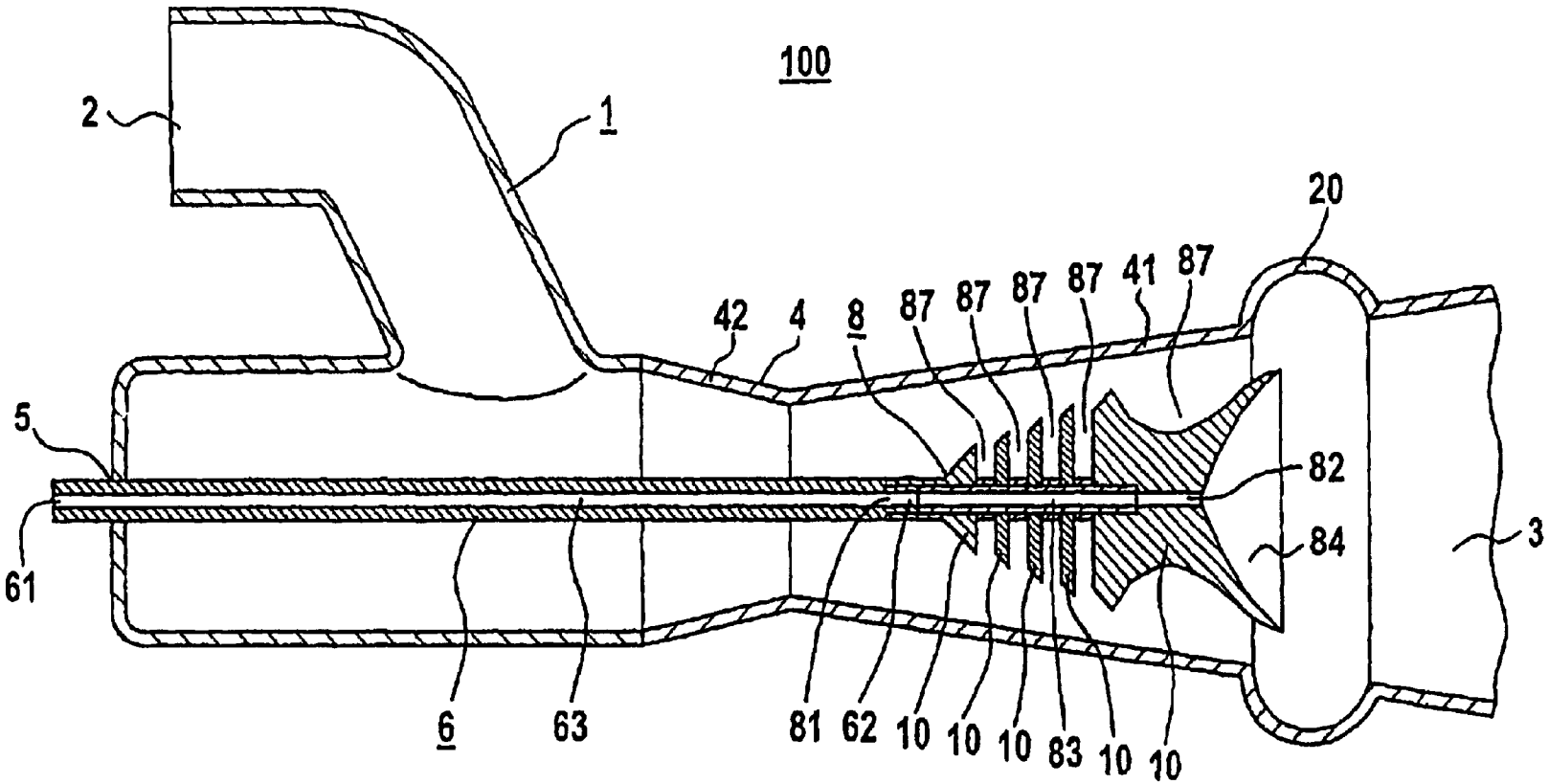
FIG. 1*b* shows a diagrammatic cross-sectional view of second exemplary embodiment of the invention, which represents a modification to the first embodiment shown in FIG. 1*a;*

FIGS. 1*a* and 1*b* serve only to illustrate the main properties of a supercavitation mixer 100 according to the invention, but are not otherwise to be understood as having any restrictive character.

FIG. 1*a* shows a diagrammatic cross-sectional view in the longitudinal direction of a supercavitation mixer 100 in accordance with a first exemplary embodiment of the invention.

As can be seen from FIG. 1*a,* the supercavitation mixer 100 according to the invention comprises a housing 1 which has an entry opening 2 and an exit opening 3. Some or all of the multicomponent mass flow which is to be mixed is fed through the entry opening 2, typically by means of a pump device (not shown). Then, the mixed mass flow is removed through the exit opening 3. The components of the mass flow which are to be mixed may be in solid, liquid or gas form, i.e. the mixed mass flow which is removed after the treatment is, for example, an emulsion, a suspension, a liquid which is saturated with dissolved gas or other substantially fluid mixtures or mixes.

The housing 1 furthermore comprises a through-flow chamber 4 and a body 8 which is arranged therein by means of a holder 6 and which it is difficult for medium to flow around. In the case of the first embodiment, the holder 6 is designed and arranged in such a way that it projects into the housing 1 through a further opening 5 in the housing, in such a manner that the body 8 which it is difficult for medium to flow around is positioned in the through-flow chamber 4.

In the embodiment which is diagrammatically depicted in FIG. 1*a,* the through-flow chamber 4, the body 8 which it is difficult for medium to flow around and the holder 6 each comprise a rotationally symmetrical body, which bodies are arranged in such a way that their axes of symmetry coincide, i.e. are identical to the center axis of the through-flow chamber 4.

In particular, in FIG. 1*a* the holder 6 substantially comprises a hollow bar, i.e. has a hollow space 63 which passes all the way through and has an inlet opening 61 and an outlet opening 62. Likewise, the body 8 which it is difficult for medium to flow around has a central bore 83 passing all the way through along its center axis, with the associated inlet opening 81 and outlet opening 82. The outlet opening 62 of the bar or holder 6 is connected to the inlet opening 81 of the body which it is difficult for medium to flow around, and the holder 6 and the body 8 which it is difficult for medium to flow around are arranged in the housing 1 or the through-flow chamber 4 in such a way that their center axes or axes of symmetry coincide and the outlet end opening 82 of the body 8 which it is difficult for medium to flow around faces the exit opening 3 of the housing 1.

In the present context and in the text which follows, the term the direction of flow of the mass flow flowing through the through-flow chamber 4 is always understood as meaning the mean or effective direction of the mass flow flowing through the through-flow chamber 4. What this means is that the effect of turbulence and the like is eliminated by forming a mean. If the through-flow chamber 4—as shown in FIGS. 1*a* and 1*b*—is rotationally symmetrical or substantially rotationally symmetrical, the direction of flow is identical to the direction of the axis of symmetry or center axis of the through-flow chamber 4.

As is shown or indicated in FIG. 1*a,* the body 8 which it is difficult for medium to flow around has at least two subregions 80 which it is difficult for medium to flow around and between each of which there is a space 87 through which medium can flow. The subregions 80 which it is difficult for medium to flow around each effect local constriction of flow in the through-flow chamber 4. Therefore, the body which it is difficult for medium to flow around, when the mass flow which is to be mixed is flowing around it in the through-flow chamber 4, generates a plurality of cavitation fields which are superimposed in one another and thereby form a supercavitation field, in particular behind the body 8 which it is difficult for medium to flow around, as seen in the direction of flow.

Figure 2A:
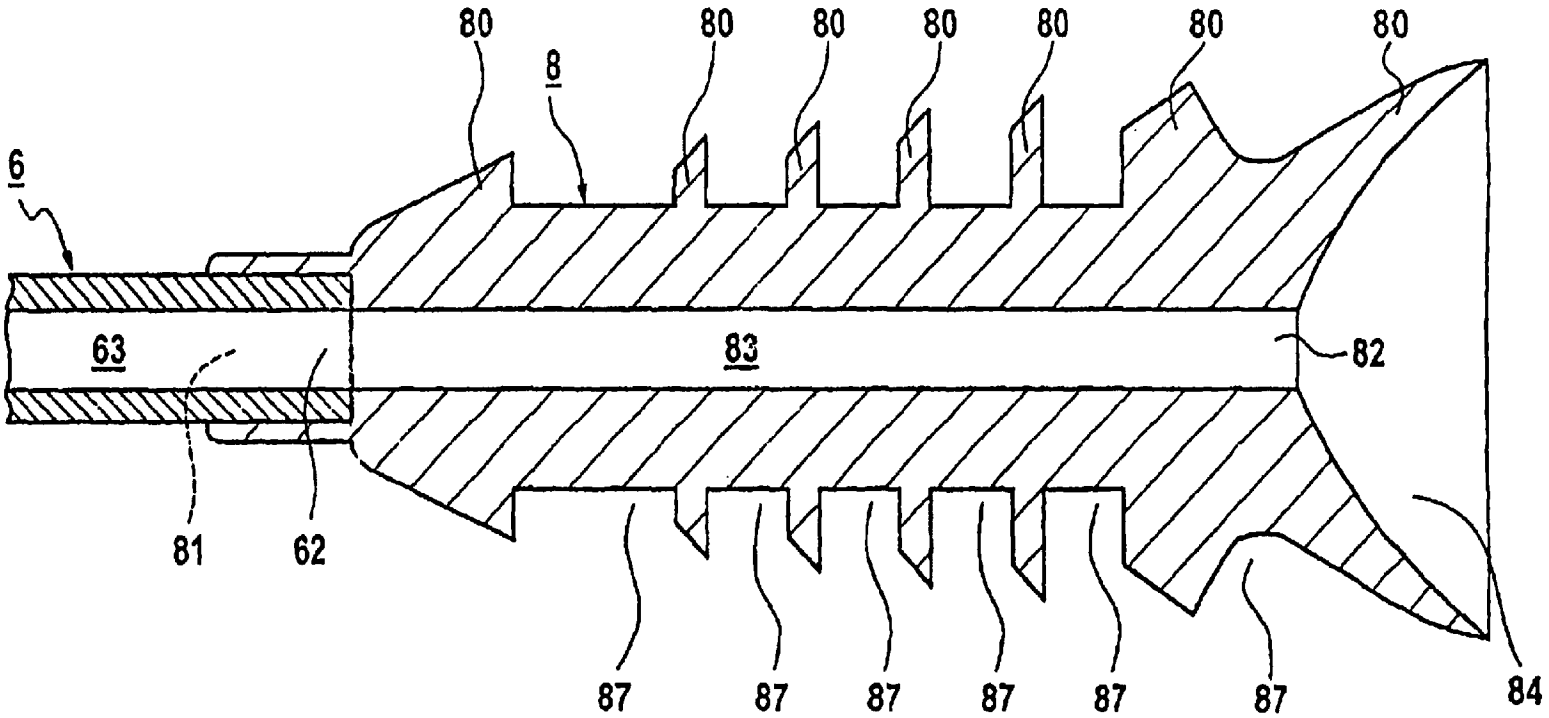
FIG. 2*a* shows a cross-sectional view of an example of a body which it is difficult for medium to flow around for the supercavitation mixer according to the invention.

FIG. 2*a* shows an enlarged diagrammatic cross-sectional view, in the longitudinal direction of the example of the body 8 which it is difficult for medium to flow around from the first exemplary embodiment shown in FIG. 1*a*.

With the exception of the final two—as seen in the direction of flow—subregions 80 which it is difficult for medium to flow around, the subregions 80 which it is difficult for medium to flow around in FIG. 1*a* or 2*a* are in the form of a truncated cone, in order to generate cavitation fields. As can be seen in particular from FIG. 2*a,* the final two subregions 80, which it is difficult for medium to flow around, of the body 8 which it is difficult for medium to flow around (i.e. the two subregions which it is difficult for medium to flow around and which, of all the subregions which it is difficult for medium to flow around, lie closest to the exit opening 3 of the housing 1) are for this purpose, as a whole, together with their associated space 87 between them, designed in such a way that this overall assembly has a cross section (taken perpendicular to the center axis of the through-flow chamber 4) which or the area of which, as seen in the direction of flow of the mass flow flowing through the through-flow chamber 4, always initially increases, then becomes smaller and then increases again. In other words, the external circumference (the circumferential line) of the end of the body 8 which it is difficult for medium to flow around in accordance with the first embodiment, has two local minima and two local maxima. Moreover, the final subregion 80 which it is difficult for medium to flow around in this case has a hollow end region 84, into which the abovementioned end outlet opening 82 also opens out. The cross section of the hollow end region 84 or the cavity 84 taken perpendicular to the center axis of the through-flow chamber, increases continuously in the direction of flow of the mass flow flowing through the through-flow chamber 4.

The truncated cones 80 are each arranged one behind the other in such a way that the area of the their cross section, taken perpendicular to the center axis of the through-flow chamber 4, increases as seen in the direction of flow. In other words, the (truncated) point of each truncated cone faces the mass flow flowing through the through-flow chamber 4, while the base of each truncated cone is closest to the exit opening 3 of the housing. The same also applies in a corresponding way to the final two subregions 80 which it is difficult for medium to flow around in the first embodiment.

Furthermore, the truncated cones are designed and arranged in such a way that—as seen in the direction of flow—each subsequent truncated cone projects slightly further—in the direction perpendicular to the center axis of the through-flow chamber 4—into the flow than the preceding truncated cones. Once again, this also applies in a similar way to the final two subregions 80 which it is difficult for medium to flow around.

As shown in FIG. 1*a,* the through-flow chamber 4 in the first embodiment has a rotationally symmetrical through-flow chamber section 41 which widens gradually in the direction of flow and the cross-sectional area of which, perpendicular to the center axis of the through-flow chamber 4, is circular and increases continuously in the direction of flow, and in which the body 8 which it is difficult for medium to flow around is arranged in such a manner that it generates a highly effective supercavitation field.

Furthermore, as shown in FIG. 1*a,* the through-flow chamber 4 at its start, i.e. at the end which lies closest to the entry opening 2 of the housing 1, has a through-flow chamber section 42 which narrows in the direction of flow and which is adjoined by the widening through-flow chamber section 41. The cross-sectional area perpendicular to the center axis of the through-flow chamber 4 of the narrowing through-flow chamber section 42 is circular and decreases continuously in the direction of flow, resulting in a flow constriction and further optimizing the formation of the cavitation fields in the subsequent region of the through-flow chamber 4 by means of the body 8 which it is difficult for medium to flow around and which is arranged therein.

FIG. 1*b* shows a diagrammatic cross-sectional view, in the longitudinal direction of a supercavitation mixer 100 in accordance with a second exemplary embodiment of the invention, which represents a modification to the first exemplary embodiment shown in FIG. 1*a*. In particular, the second embodiment of the invention differs from the first by dint of only two modifications.

The first modification relates to the body 8 which it is difficult for medium to flow around and which in the second embodiment is designed in such a way that each of its subregions 80 which it is difficult for medium to flow around and which is in the form of a truncated cone is designed as a partial body 10. Accordingly, the last two—as seen in the direction of flow—subregions 80, which it is difficult for medium to flow around, of the first embodiment are now designed as a single partial body 10. The spaces 87 through which medium can flow, between the subregions 80 or partial bodies 10 which it is difficult for medium to flow around are produced by means of spacers 9. Overall the body 8 which it is difficult for medium to flow around in the second embodiment is in particular in the same form as the body belonging to the first embodiment (cf. in this respect also FIG. 2*b,* which illustrates an enlarged diagrammatic cross-sectional view in the longitudinal direction of the example of the body 8, which it is difficult for medium to flow around, of the second exemplary embodiment shown in FIG. 1*b,* with the analogous FIG. 2*a*).

The second modification relates to the through-flow chamber 4, which additionally has a bulge 20 in the second embodiment. As shown in FIG. 1*b,* a region of the through-flow chamber which has a rotationally symmetrical bulge 20 in the wall of the through-flow chamber 4 along its circumference adjoins the widening through-flow chamber 41 of the through-flow chamber 4, this bulge 20 being located partially in the end region of the body 8 which it is difficult for medium to flow around. The increase in the cross section of the through-flow chamber 4, as seen in the direction of flow, which is brought about by the bulge 20 can further intensify and optimize the cavitation effect and mixing effect of the supercavitation mixer 100 in accordance with the second embodiment.

As a modification to the second embodiment—and also to corresponding further embodiments as will be discussed below—the bulge 20 may also be located elsewhere, i.e., as seen in the direction of flow, it may also only start immediately downstream—or a short distance downstream—of the body 8 which it is difficult for medium to flow around, or it may be arranged completely in the region of the body 8 which it is difficult for medium to flow around—for example around its center or its end.

It will also be understood that the bulge 20, in a corresponding embodiment, does not necessarily have to be rotationally symmetrical, even if the through-flow chamber 4 is rotationally symmetrical and equally the bulge 20 does not have to be designed to be uninterrupted or continuous along the circumference of the through-flow chamber 4. The shape and arrangement of a bulge 20—or of a plurality of bulges—results solely from the way in which the cavitation effect and the mixing effect of the supercavitation mixer 100 according to the invention is intensified and optimized.

At this point, it should be emphasized that any possible embodiment of the supercavitation mixer 100 according to the invention is distinguished in particular by the fact that the cross section of the through-flow chamber 4, taken perpendicular to its center axis, at least in a part of the region which surrounds the body 8 which it is difficult for medium to flow around, increases in the direction of flow of the mass flow flowing through the through-flow chamber 4. This widening part of the through-flow chamber 4 is significant for the production of the ultraeffective supercavitation field according to the invention, since the cavitation fields which are then caused by the body 8 which it is difficult for medium to flow around acquire a particularly high cavitation effect or mixing effect, i.e. their superimposition—the supercavitation field—is able to generate a mixture of the components of a mass flow flowing through the through-flow chamber 4 which is particularly homogeneous and has particularly good long-term stability compared to the mixtures which have hitherto been known from the prior art, even for components which according to the prior art are very difficult to mix, and even without the use of additional substances which have a mixing effect (additives), as has been demonstrated experimentally.

And this widening part of the through-flow chamber 4 may, in general terms be produced in such a way that the through-flow chamber 4 according to the present invention as a whole or only in one subregion or in a plurality of subregions, which are not necessarily linked and which subregion(s) each surround at least a part of the body 8 which it is difficult for medium to flow around, is designed in such a way that the cross section of the through-flow chamber 4 in this widening part of the through-flow chamber 4 increases in the direction of flow of the mass flow flowing through the through-flow chamber 4.

This widening part of the through-flow chamber 4 may be produced in particular by a continuously widening, rotationally symmetrical through-flow chamber section 41 as shown in FIG. 1*a* or only by means of a front sub-region of a bulge 20 or by a combination of two such regions 41 and 20, as shown in FIG. 1*b*. Other corresponding individual or distributed subregions of a through-flow chamber 4, which are not necessarily rotationally symmetrical and do not necessarily extend all the way around the through-flow chamber 4, provided only that they all lie at least partially in the region of the body 8 which it is difficult for medium to flow around and that their cross section increases in the direction of the mass flow flowing through the through-flow chamber 4, are also suitable.

The text which follows will now describe further modifications to the above-described first and second embodiments and their modifications, which can all be produced independently of one another and can be combined and then each in turn represent a further possible embodiment of the supercavitation mixer 100 according to the invention.

Unlike the first and second embodiments, which are diagrammatically depicted, by way of example, in FIGS. 1*a* and 1*b*, neither the rotational symmetry of the through-flow chamber 4 nor that of the body 8 which it is difficult for medium to flow around nor that of the holder 6 nor their common rotationally symmetrical arrangement has to be present for all embodiments of the invention, but rather only has to be present to the extent required in order to generate the corresponding cavitation fields.

The body which it is difficult for medium to flow around, when the mass flow which is to be mixed is flowing around it in the through-flow chamber 4, generates a plurality of cavitation fields which are superimposed in one another and thereby form a super-cavitation field, in particular downstream of the body 8 which it is difficult for medium to flow around, as seen in the direction of flow. It should be noted that this supercavitation field—depending on the specific design of the body 8 which it is difficult for medium to flow around, of the through-flow chamber 4 and their relative arrangement with respect to one another—also extends partially or completely around the body 8 which it is difficult for medium to flow around.

In the first and second embodiments, the holder 6 for the body 8 which it is difficult for medium to flow around is designed in such a way (as a bar) and arranged in such a way that it projects into the housing and the through-flow chamber 4 through an opening 5 in the housing 1. However, the holder 6 can in principle be of any desired design, for example as a toroidal device, resembling a wheel with spokes, in such a manner that it can be arranged entirely in the through-flow chamber 4 of the housing 1, for example, at a partial region of the inner wall of the through-flow chamber 4, in a similar manner to that described in DE-A 4433744.

Furthermore, although this is not shown or not visible in FIGS. 1*a* and 1*b*, the holder 6 may comprise a device or may be connected to a device which is suitable for displacing the body 8 which it is difficult for medium to flow around—on its own or in combination with the holder 6—along the direction of the center axis of the through-flow chamber 4 in the region of this through-flow chamber. Therefore, the body 8 which it is difficult for medium to flow around as a whole can be displaced and positioned with respect to the widening part of the through-flow chamber 4 (for example produced by a widening through-flow chamber section 41 and/or a bulge 20 of the through-flow chamber 4) in such a manner that the mixing action of the supercavitation field produced by the body 8 which it is difficult for medium to flow around can be set optimally, both with regard to the nature of the components which are to be mixed and with regard to further process parameters and/or target parameters of the desired mixed mass flow.

Particularly simple adjustment or regulation of the supercavitation field in this way can be achieved if part or all of the through-flow chamber 4 is designed to be transparent, for example is made from a corresponding plastic, so that this adjustment can immediately be checked and performed visually.

As has already been discussed in connection with the first and second embodiments, the body 8 which it is difficult for medium to flow around may comprise a single piece or a multiplicity of partial bodies 10 which it is difficult for medium to flow around and which are arranged accordingly. It should be emphasized that this "breaking up" of the body 8 which it is difficult for medium to flow around can be carried out in any desired way, provided only that its overall shape is suitable—in combination with the correspondingly configured through-flow chamber 4—for production of the supercavitation field according to the invention. In particular, each partial body 10 which it is difficult for medium to flow around may comprise one or more of the subregions 80, which it is difficult for medium to flow around, of the body 8 which it is difficult for medium to flow around.

Figure 2B:
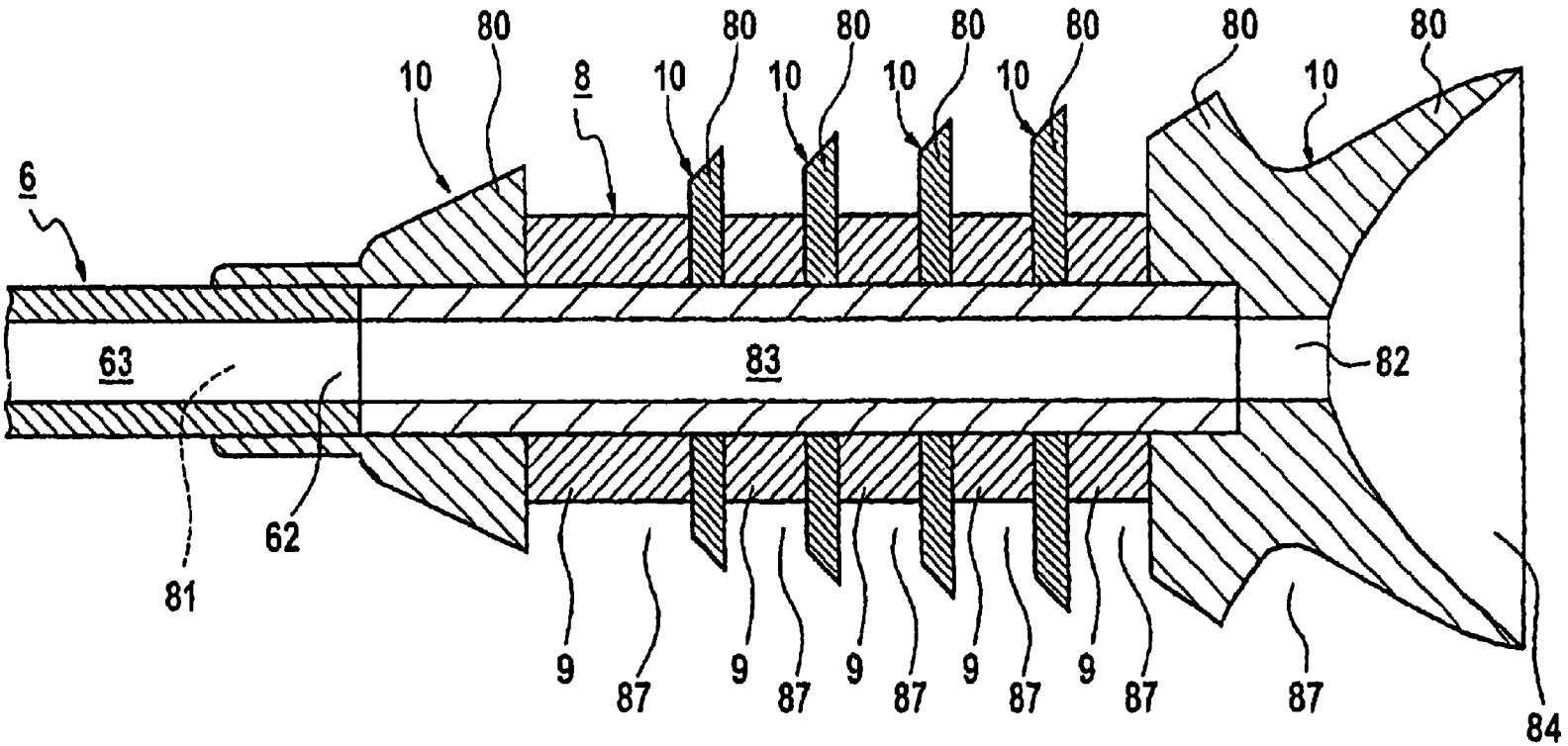
FIG. 2*b* shows a cross-sectional view of a modification to the example of the body which it is difficult for medium to flow around shown in FIG. 2*a;*

As shown in FIG. 2*b*, the individual partial bodies 10 may, by means of spacers 9, be arranged at a respectively predetermined distance from one another along the center axis of the body 8 which it is difficult for medium to flow around. The spaces 87 through which medium can flow, between the subregions 80 which it is difficult for medium to flow around or the partial bodies 10 which it is difficult for medium to flow around of a body 8 which it is difficult for medium to flow around may be individually set in such a way that the mixing effect of the supercavitation field which is generated can be intensified and optimized.

The spacers 9 may consist of an elastic material, for example plastics, so that the medium flowing through the through-flow chamber 4, the cavitation fields which are generated and the partial bodies 10 are in a linked relationship, in such a manner that the partial bodies 10 are set in vibration, so that in turn the cavitation effect or mixing effect of the cavitation fields is intensified and optimized.

One example of a further possibility in this respect is for the partial bodies 10 of a body 8 which it is difficult for medium to flow around each to be secured or arranged at the end of a hollow rod, so that the body which it is difficult for medium to flow around can be produced by fitting the individual bars together accordingly, the cross section of these bars in each case increasing accordingly, in a similar manner to that described in EP-A 0 644 271. Fitted-together bars as described above, each with a partial body 10 at their end, can then be displaced independently of one another along the direction of their center axis. In other words, each of the partial bodies 10 of a body 8 which it is difficult for medium to flow around and which is designed in this way can be displaced independently of all the others along the direction of the center axis of the through-flow chamber 4.

In the example which has just been described, the assembly of the hollow bars represents the holder 6. However, further configurations of the body 8 which it is difficult for medium to flow around and of the holder 6 will be immediately apparent to the person skilled in the art, such that a body 8 which it is difficult for medium to flow around and which comprises a plurality of partial bodies 10 is designed in such a way that at least one of its partial bodies 10, independently of all the others, can be displaced along the direction of the center axis of the through-flow chamber 4.

As can be seen from FIGS. 1*a*, 1*b*, 2*a* and 2*b*, the subregions 80, which it is difficult for medium to flow around, and/or the partial bodies 10, which it is difficult for medium to flow around, of a body 8 which it is difficult for medium to flow around are typically in the shape of a truncated cone. However, related shapes, such as the shape of a truncated cone with an undulating surface or the shape of a hemisphere, are likewise suitable for generating cavitation fields.

In general terms, each subregion 80, which it is difficult for medium to flow around, or each partial body 10, which it is difficult for medium to flow around, of a body 8 which it is difficult for medium to flow around, is designed in such a way that its cross section, taken perpendicular to the center axis of the through-flow chamber, at the end of the partial body 8, which lies closest to the entry opening 2 of the through-flow chamber 4, is smaller than at the end of the partial body which lies closest to the exit opening 3 of the through-flow chamber 4.

In the case of truncated cones or hemispheres, what this means is that they are in each case arranged one behind the other in such a way that the area or the external contour line of their cross section, taken perpendicular to the center axis of the through-flow chamber 4, increases as seen in the direction of flow, as can be seen from FIGS. 1 and 2. In other words, the "point" of each truncated cone or of each hemisphere faces the mass flow flowing through the through-flow chamber 4, while the base of each truncated cone or of each hemisphere is closest to the exit opening 3 of the housing.

In the example described in the previous paragraph, the truncated cones or hemispheres may also—as seen in the opposite direction to the direction of flow (from their base)—be hollowed out, i.e. may be in the form of hollow truncated cones or hollow hemispheres. This also applies in general terms, i.e. the subregions 80 or partial bodies 10 may likewise in all or some cases be hollowed out as seen in the opposite direction to the direction of flow.

It has proven advantageous for the generation of the cavitation fields if the outermost edge of a subregion 80 or of a partial body 10, i.e. the edge region which is at the maximum distance from the center axis of the through-flow chamber 4 and thereby determines the extent of flow constriction, in each case in the direction perpendicular to the center axis of the through-flow chamber 4, extends slightly further into the mass flow which is flowing through than the outermost edge of a subregion 80 or partial body 10 located upstream of it, as seen in the direction of flow. FIGS. 1 to 2 show corresponding subregions 80 or partial bodies 10 to which this applies. However, it will be understood that this does not in general terms have to be true of each or all the subregions 80 or partial bodies 10 of a body 8 which it is difficult for medium to flow around, provided that the overall shape of the body 8 which it is difficult for medium to flow around is still able—in combination with the correspondingly designed through-flow chamber 4—to generate the supercavitation field according to the invention.

To optimize the formation of the cavitation fields and their mixing effect, a subregion 80 or partial body 10 which it is difficult for medium to flow around may also be designed in such a way that it has a multiplicity of elevations 88 on part of its surface. By way of example, these elevations 88 may be in the form of small cone points or a related shape.

Figure 3A:
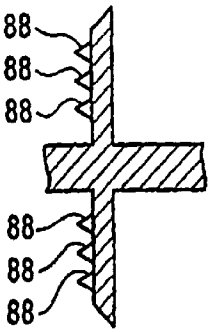
FIGS. 3*a* to 3*f* show cross-sectional views of examples of subregions, which it is difficult for medium to flow around, of the body which it is difficult for medium to flow around, in particular of its end subregion which faces the exit opening of the housing.

If the subregion 80 or partial body 10 is in the form of a hollow or solid truncated cone, as indicated diagrammatically in cross section in FIG. 3*a,* and if the elevations 88 in turn are in the form of small cone points, it is advantageous if these cone points are oriented in such a way that their axes of symmetry are all oriented parallel to one another and to the direction of flow of the mass flow flowing through the through-flow chamber 4, and that each cone point faces the mass flow flowing through the through-flow chamber 4, as shown in FIG. 3*a* (in FIG. 3*a,* the direction of flow corresponds to the direction from the left to the right).

As an alternative to FIG. 3*a,* the small elevations 88 may, of course, be oriented and/or designed differently, partially as a function of the design of the subregions 80 or partial bodies 10. By way of example, concentrically arranged, annular elevations 88 with a sharp top edge which in each case completely or partially faces the mass flow flowing through the through-flow chamber 4 are also advantageous.

Although in the embodiments shown in FIGS. 1*a* and 1*b* the through-flow chamber 4 at its beginning, i.e. at the end which lies closest to the entry opening 2 of the housing 1, has a through-flow chamber section 42 which narrows in the direction of flow, in order to assist the formation of the cavitation fields in the subsequent region of the through-flow chamber 4 by means of the body 8 which it is difficult for medium to flow around and which is arranged therein, it would be clear that this does not necessarily have to be the case. For example, this section of the through-flow chamber 4 may also be cylindrical or may be in any other form, for example with a constant cross section.

As has already been described in combination with the first and second embodiments, it has proven advantageous for the end of the body 8 which it is difficult for medium to flow around, i.e. the two subregions 80 which it is difficult for medium to flow around (plus the associated intervening space 87 through which medium can flow) and/or the partial body 10 lying closest of all the subregions or partial bodies to the exit opening 3 of the housing 1 to be designed in such a way that its cross section, taken perpendicular to the center axis of the through-flow chamber 4, as seen in the direction of flow of the mass flow flowing through the through-flow chamber 4, initially increases and then becomes smaller and then increases again.

Figure 2C:
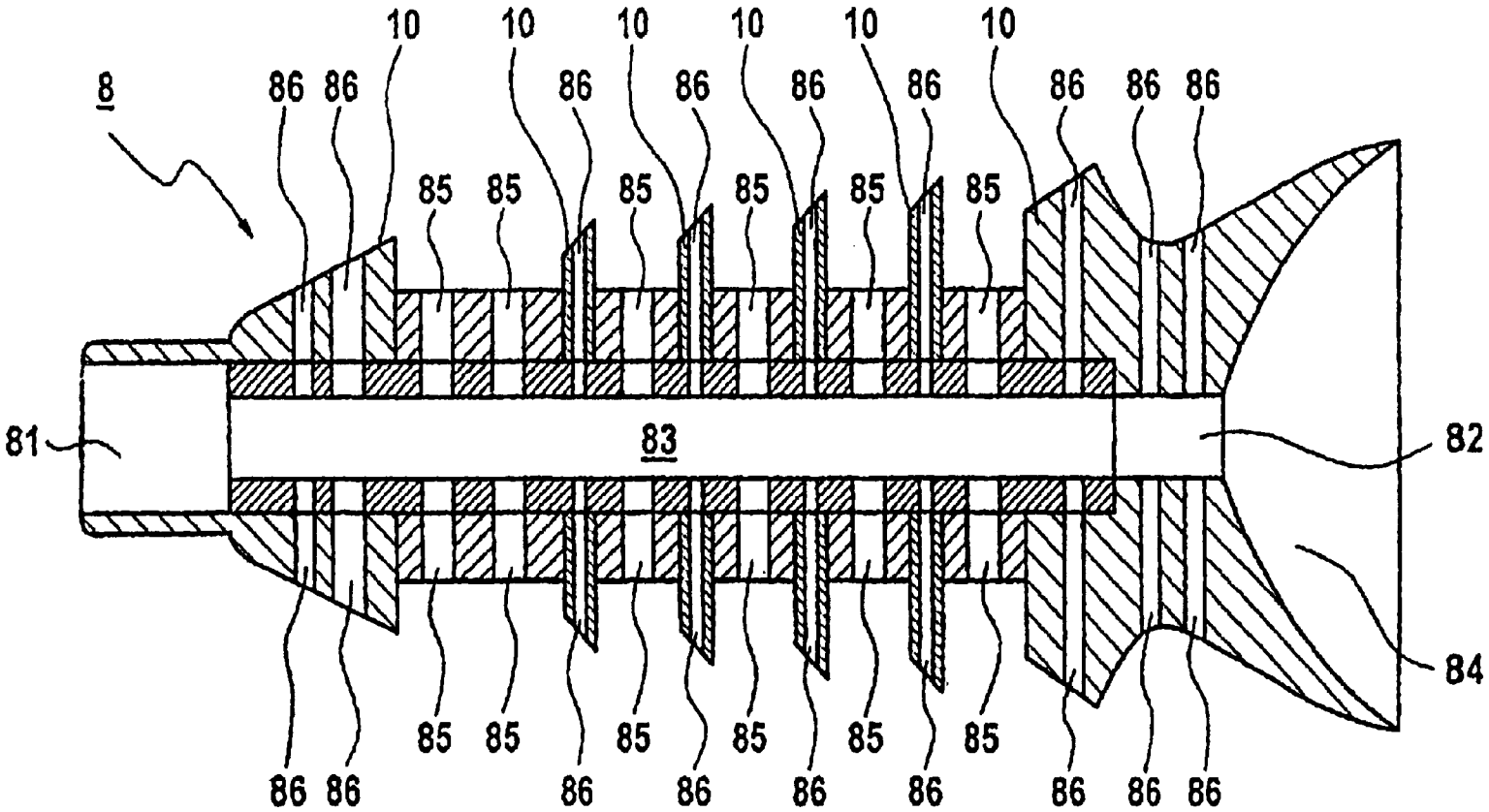
FIG. 2*c* shows a cross-sectional view of a further modification to the example of a body which it is difficult for medium to flow around shown in FIG. 2*a* and FIG. 2*b;*
Figure 3B:
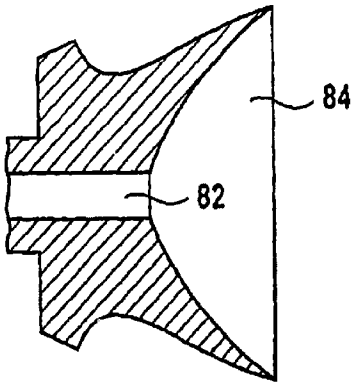
Figure 3C:
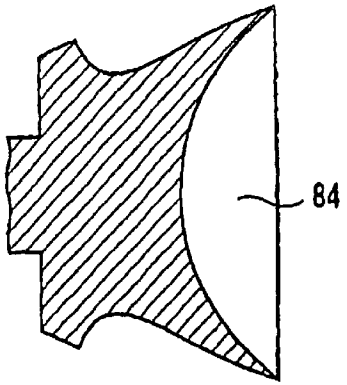

Examples of this configuration are shown in FIGS. 3*b* to 3*f,* which illustrate diagrammatic cross-sectional views along the longitudinal direction or axis of symmetry of a rotationally symmetrical end subregion or end partial body of a body 8 which it is difficult for medium to flow around. As can be seen from FIGS. 3*b* to 3*f,* in this configuration of the body 8 which it is difficult for medium to flow around, the area or the outer circumferential line of the associated cross section, from the left to the right in the figures—which in FIGS. 1 to 3 is equivalent to the direction of flow of the mass flow flowing through the through-flow chamber 4—starting from an initial value (local minimum), initially increases continuously—not necessarily linearly—up to a first local maximum and then decreases continuously down to a local minimum cross-section value, from where it increases again continuously until reaching a global maximum right at the end of the final subregion or partial body. It will be understood that this cross-sectional characteristic is independent of whether the body which it is difficult for medium to flow around is completely solid or has a bore 82 passing all the way through it, as shown in FIGS. 3*c,* 3*e* and 3*f* and in FIGS. 3*b* and 3*d,* respectively.

Figure 3D:
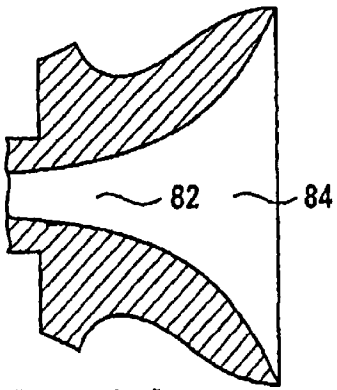
Figure 3E:
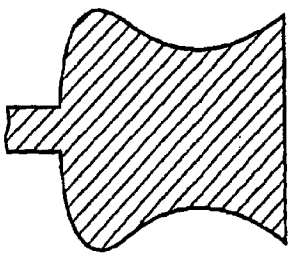

In general terms, the end of the body 8 which it is difficult for medium to flow around may be solid or planar—as for example in FIG. 3*e*—or may in general terms have a hollow end region 84 which faces the exit opening 3 of the housing 1, the cross section of this hollow space, taken perpendicular to the center axis of the through-flow chamber, increasing continuously in the direction of flow of the mass flow flowing through the through-flow chamber 4, as shown, for example, in FIGS. 3*b,* 3*c,* 3*d* and 3*f.* In the case of the rotationally symmetrical end, shown in each of FIGS. 3*b,* 3*c,* 3*d* and 3*f,* of the body 8 which it is difficult for medium to flow around, this means that the cross section of the hollow space 84, taken perpendicular to the center axis of the through-flow chamber, is in the shape of a circle, and that the area of these cross-sectional circles increases continuously in the direction of flow.

As shown in FIGS. 3*b* and 3*c,* the hollow end region 84 may be designed in such a way that each of its cross-sectional areas which is taken in the longitudinal direction and completely includes its axis of symmetry has a contour line which runs mathematically convexly, as seen in the direction of flow of the mass flow flowing through the through-flow chamber 4. In a similar manner, and as shown in FIGS 3*d* and 3*f,* this contour line may run mathematically concavely.

Figure 3F:
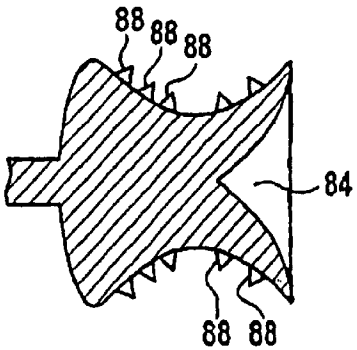

In the case of the configuration of the end of the body which it is difficult for medium to flow around as shown in FIG. 3*f,* it will also be noted that in this case a multiplicity of elevations 88 are arranged on part of its surface, either in the form of small cone points, or in the form of concentrically arranged, annular elevations with a sharp top edge.

Figure 4B:
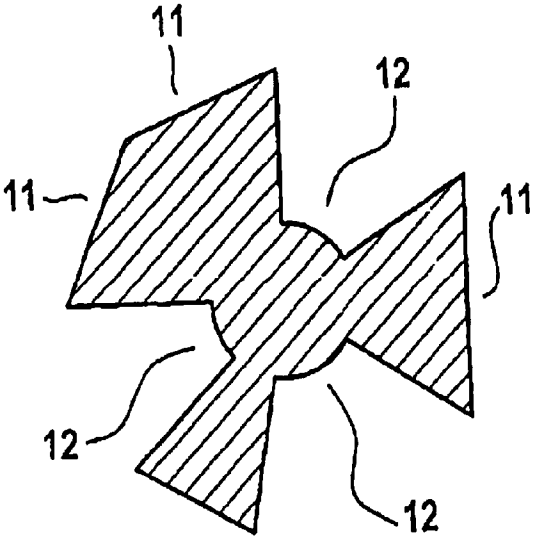
FIGS. 4*a* and 4*b* show diagrammatic plan views as seen in the direction of flow, of examples of bodies which it is difficult for medium to flow around.
Figure 4A:
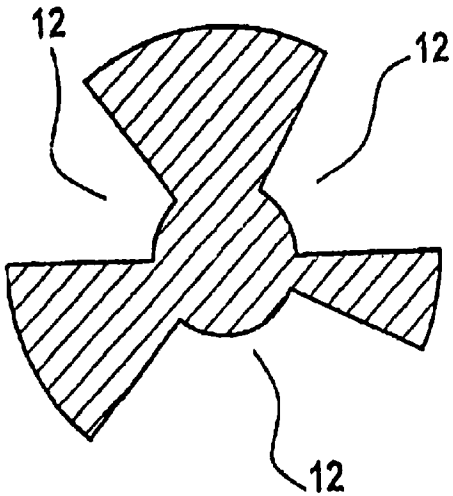

Irrespective of all the configurations and modifications which have been discussed hitherto with respect to the body 8 which it is difficult for medium to flow around, it should be noted that a subregion 80 which it is difficult for medium to flow around or a partial body 10 which it is difficult for medium to flow around does not have to be rotationally symmetrical or symmetrical in any other sense or continuous. For example, in a similar manner to that shown in EP-A 644271, a subregion 80 or partial body 10 which it is difficult for medium to flow around may have cutouts which pass all the way through as seen in the direction of flow. For example, FIGS. 4*a* and 4*b* show examples of subregions 80 or partial bodies 10 which it is difficult for medium to flow around, as seen in the direction of flow, the cross section of these subregions or partial bodies, taken perpendicular to the center axis of the through-flow chamber 4, having the area of a circle minus a plurality of segments 11 and/or minus a plurality of sectors, or more specifically circular ring parts 12.

To ensure the body 8 which it is difficult for medium to flow around is not itself damaged by the action of the cavitation fields, it is advantageous if it at least partially comprises an elastic, nonmetallic material or at least partially includes an elastic, nonmetallic covering, for example, comprising a suitable plastic.

The body 8 which it is difficult for medium to flow around and the holder 6 may in general terms be of solid design. However, they may also in general terms each be provided with a hollow space 83 or 63 which passes all the way through and may be connected to one another via corresponding openings 82 and 81, so that part of the mass flow which is to be mixed can be introduced into the through-flow chamber not via the entry opening 2 of the housing 1, but rather directly via a corresponding inlet opening 61 of the holder 6 and a corresponding outlet end opening 82 of the body 8 which it is difficult for medium to flow around. This is particularly advantageous if the part of the mass flow to be mixed which is to be introduced into the through-flow chamber directly in this way is in gas form and the other part, which is introduced via the entry opening 2 of the housing 1, is liquid.

For this purpose, the body 8 which it is difficult for medium to flow around may, of course, have more than one outlet opening 82, which, depending on the desired mixing effect and cavitation effect of the corresponding supercavitation mixer 100 according to the invention, are distributed in a suitable way over the entire body 8 which it is difficult for medium to flow around.

For example, FIG. 2*c* shows a body 8 which it is difficult for medium to flow around and which, although its overall external shape resembles that of the first or second embodiment, also has a hollow space 83, with a plurality or outlet openings, passing all the way through it. One of these outlet openings is the central outlet end opening 82 which has already been shown in FIGS. 1*a* and 1*b*.

Furthermore, the body 8 which it is difficult for medium to flow around, is shown in FIG. 2*c* and in principle represents a further development of the body 8 which it is difficult for medium to flow around and is shown in FIG. 2*b,* has a hollow space 83 passing all the way through it, with intermediate outlet openings 85 which are in each case located in a surface subregion of the body 8, which it is difficult for medium to flow around, which at least partially faces the inner wall of the through-flow chamber 4 and is located between two adjacent subregions 80, which it is difficult for medium to flow around, or partial bodies 10, which it is difficult for medium to flow around, of the body 8 which it is difficult for medium to flow around.

Furthermore, the body 8 which it is difficult for medium to flow around and which is shown in FIG. 2*c* has a hollow space 83 passing all the way through it, with outlet side openings 86, which are each located in a surface subregion of the body 8, which it is difficult for medium to flow around, which at least partially faces the inner wall of the through-flow chamber 4 and is located in the region of a subregion 80 which it is difficult for medium to flow around, or a partial body 10, which it is difficult for medium to flow around, of the body 8 which it is difficult for medium to flow around.

It will be understood that neither the intermediate outlet openings 85 nor the outlet side openings 86 have to be arranged symmetrically as shown in FIG. 2*c*. Likewise, the hollow space 83 which passes all the way through the body 8 which it is difficult for medium to flow around may have only an outlet end opening 82 or only one or more intermediate outlet openings 85 or only one or more outlet side openings 86. Alternatively, the hollow space 83 which passes all the way through may have only one or more intermediate outlet openings 85 or only one or more outlet side openings 86. In this case too, where an outlet end opening 82 is present, the latter may also be replaced by a plurality of outlet end openings 82 which are arranged appropriately, are located at the end of the body 8 which it is difficult for medium to flow around and face the exit opening 3 of the housing 1.

Irrespective of all the embodiments and modifications thereof which have been described hitherto, the supercavitation mixer according to the invention may furthermore comprise an ultrasound device and/or a laser device, in order to optimize the mixing effect and/or cavitation formation of the device as a whole.

For this purpose, ultrasound may be applied directly to part or all of the body 8 which it is difficult for medium to flow around. This sets the body 8 which it is difficult for medium to flow around in vibration, either in its entirety or in suitable subregions. Irrespective of this, ultrasound can also be applied to the mass flow which is flowing through at a suitable location in the through-flow chamber 4—or alternatively at a plurality of locations or alternatively in the entire through-flow chamber 4—in order, for example, to generate turbulence, pressure waves, ultrasound cavitation or related effects which assist or supplement the formation of hydrodynamic cavitation and/or have further positive effects on the mixing action of the device as a whole. Furthermore, an ultrasound device may also set the body which it is difficult for medium to flow around or parts of this device directly in ultrasonic vibration, as well as a suitable part of the through-flow chamber 4 or the whole of the through-flow chamber 4, in order to achieve the effects and benefits or the like which have just been described.

Similarly, a laser device may apply laser light to the mass flow or part of the mass flow in the through-flow chamber 4, in order in this way, by way of example, to generate or assist cavitation, for example including by local heating, which inter alia may also have an influence on the direction of flow and on the formation of turbulence.

Figure 5:
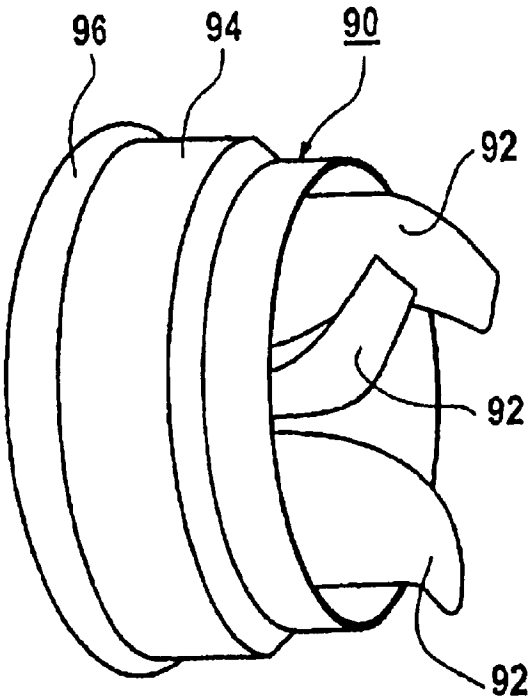
FIG. 5 shows a perspective view of an example of a helix device with helically designed elements, which can be arranged at the start and/or end of the through-flow chamber, in order to additionally mix the mass flow which is flowing through it.

Furthermore, in order to assist the mixing effect of the device as a whole, in all the embodiments and modifications thereof which have been discussed hitherto, a helix device 90 may be provided in each case at the start and/or end of the through-flow chamber 4, i.e. at the end which lies closest to the entry opening 2 of the housing 1 and/or at the end which lies closest to the exit opening 3 of the housing 1, as diagrammatically sketched in a perspective view in FIG. 5.

A helix device 90 substantially comprises a multiplicity of helically designed elements 92 and an outer wall 94, which is designed in such a way that the helix device 90 can be arranged and secured at the corresponding end of the passage chamber 4, for example by means of a rubber seal 96. The outer wall 94 surrounds a continuous hollow space in which the multiplicity of helical elements 92 are arranged. The helical elements 92 are in this case of elongate, substantially planar or two-dimensional form and run substantially in the direction of the direction of flow of the mass flow flowing through the through-flow chamber 4, but are twisted or bent in the form of a screw or a helix or a spiral along this direction, and are secured, by way of example by means of part of their longitudinal edge, to the inner side of the outer wall 94, in such a way that the mass flow which is flowing through is divided into a plurality of substreams, which, moreover, are in each case set in rotation by the helical design of the elements 92. This principle of mixing flows by means of helical devices is generally known in the specialist field.

A plurality of supercavitation mixers 100 according to the invention, in each case in accordance with one of the embodiments described above and modifications thereof, can be combined or coupled with one another in such a manner that the supercavitation field which is generated by each individual supercavitation mixer 100, according to the invention, is superimposed with the supercavitation fields generated by all the other supercavitation mixers 100. In a means 200 of this type, as illustrated diagrammatically in FIG. 6 in a cross-sectional view on the basis of two coupled supercavitation mixers 100, the superimposition of the plurality of supercavitation fields makes it possible to raise their cavitation effect and mixing effect overall to further higher powers.

Moreover, a means 200 of this type has the advantage that it is not necessary for an entire mass flow to be forced through a single device by means of a suitably dimensioned pump, but rather this total flow which is to be mixed can be divided between the individual supercavitation mixers 100 belonging to the means 200, so that each supercavitation mixer 100 only requires a pump of significantly smaller dimensions. This increases the effectiveness or energy utilization of the means.

Figure 6:
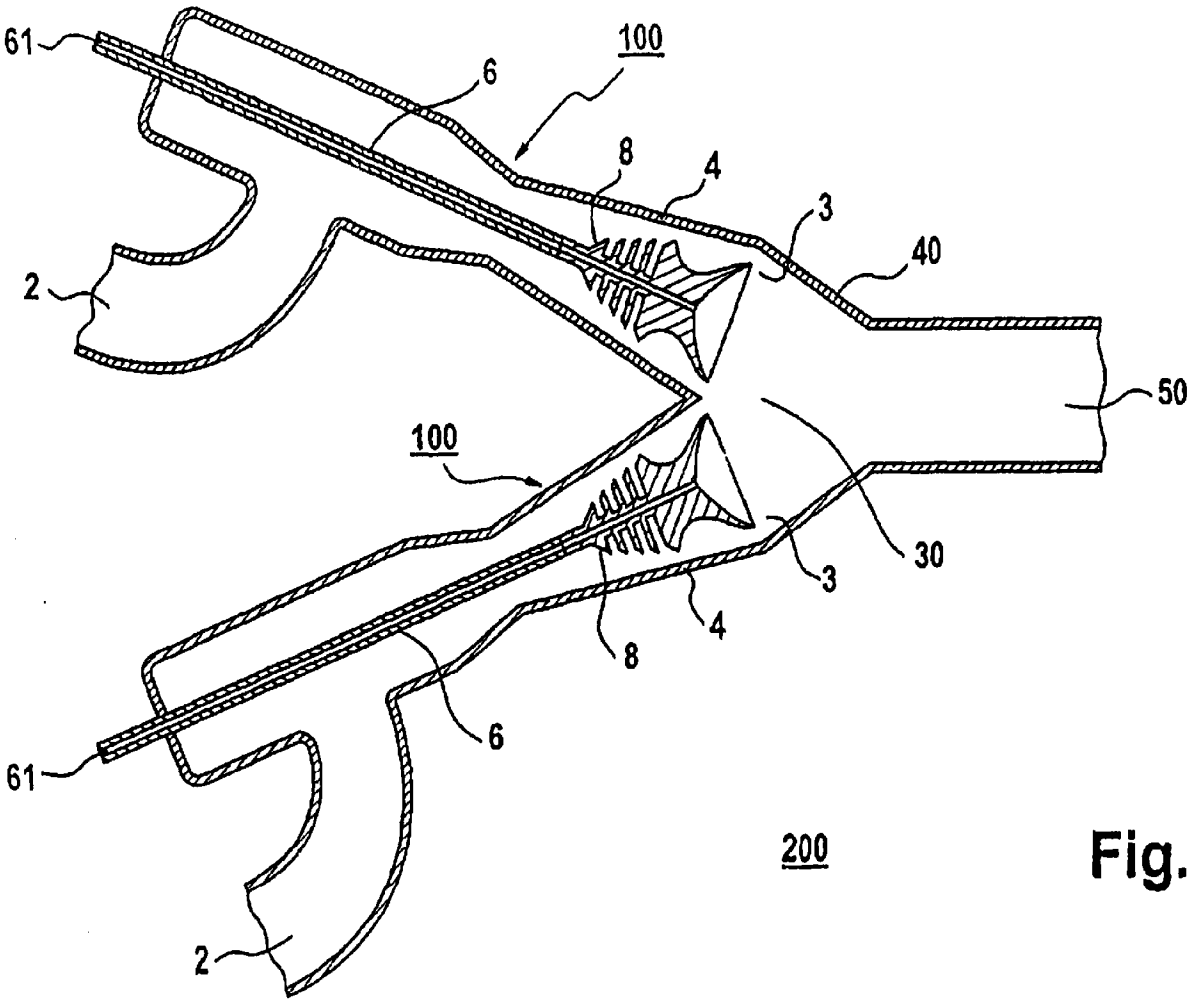
FIG. 6 shows a diagrammatic cross-sectional view of an example of a coupling of two supercavitation mixers according to the invention, in such a manner that their respective supercavitation fields are three-dimensionally superimposed.

In the means 200 shown in FIG. 6, the individual supercavitation mixers 100 are connected and coupled to one another in such a way that their individual through-flow chambers 4 merge seamlessly into a subsequent common through-flow chamber 40. In other words, the exit openings 3 of the housings 1 of the supercavitation mixers 100 are connected or superimposed to form a single common opening 30 which represents the entry opening of the common subsequent through-flow chamber 40. In the region of the entry opening 30, i.e. in the entry region of the common through-flow chamber 40, the supercavitation fields generated by each supercavitation mixer 100 are then superimposed in one another. After it has been acted on by the superimposed cavitation fields, the entire mass flow flowing through the means 200 is removed through the exit opening 50 of the through-flow chamber 40.

It will also be seen that in the means 200 the individual supercavitation fields are advantageously superimposed symmetrically on one another, i.e. three-dimensional regions of the respective supercavitation fields which are equivalent to one another are superimposed in one another. If these are the regions with the strongest or optimum cavitation effect of each supercavitation field, the superimposition optimally raises the effect of these fields to a higher power. However, this symmetrical nature of superimposition may also be abandoned if this may or should result in an improved mixing effect or other desired effects.

A means which is analogous to the above means 200 and in which a plurality of supercavitation fields are superimposed is also possible with the supercavitation mixers disclosed in DE-A 4433744.

In all the embodiments which have been described hitherto and modifications thereto, it should be noted that the mass flow which is passed through a supercavitation mixer 100 according to the invention, after it has been removed from the exit opening 3 of the housing 1 (or the exit opening 50 of the through-flow chamber 40), can be partially or completely returned via the entry opening 2 of the housing 1 and/or the corresponding inlet opening 61 of the holder 6—in order to be completely or partially treated again in the same way. Of course, this also applies in a similar way to the means 200 in which a plurality of supercavitation mixers are coupled.

Finally, it should be emphasized once again that all configurations of the body 8 which it is difficult for medium to flow around in which this body comprises a plurality of individual parts may also be produced in a corresponding way such that the body which it is difficult for medium to flow around comprises a single piece. In this case, all that is lost is the possibility of independent mobility of corresponding individual parts relative to one another.

To summarize, a device 100 according to the invention for mixing the components of a mass flow which is flowing through it provides a mixture which is particularly homogeneous and has extremely long-term or any desired long-term stability, even when components which were immiscible or extremely difficult to mix in accordance with the prior art are being mixed, and even without the use of additional substances (additives, emulsifiers, and the like) to assist the mixing effect. The device 100 has a body 8 which it is difficult for medium to flow around, is arranged in a through-flow chamber 4 and is at least partially arranged in a part of the through-flow chamber 4 which widens in the direction of flow, so that the cavitation effect and mixing effect of the supercavitation field generated by the body 8 which it is difficult for medium to flow around is significantly intensified and optimized.

What is claimed is:

1. Device (100) for mixing the components of a mass flow flowing through it, in which the components may in particular be in solid, liquid or gas form, by means of a hydrodynamic supercavitation field, in order to generate a mixture, in particular an emulsion or suspension, having a housing (1), which has an entry opening (2) for supplying at least part of the mass flow which is to be mixed and an exit opening (3), for removing the mass flow; the housing (1) having a through-flow chamber (4) with a body (8), which it is difficult for medium to flow around, arranged therein by means of a holder (6), and the body (8) which it is difficult for medium to flow around having at least two subregions (80; 10) which it is difficult for medium to flow around and which are each responsible for local constriction of the flow, characterized in that the through-flow chamber (4), at its start, has a through-flow chamber section (42) which narrows in the direction of flow, and in that the internal diameter of the through-flow chamber (4), following the narrowing through-flow chamber section (42), at least in the region which surrounds the body (8) which it is difficult for medium to flow around, increases in the direction of flow of the mass flow flowing through the through-flow chamber (4), wherein the body (8) which it is difficult for medium to flow around can be displaced along the direction of the center axis of the through-flow chamber (4), the subregions (80: 10), which it is difficult for medium to flow around, of the body (8) which it is difficult for medium to flow around are produced by means of a plurality of part-bodies (10) which it is difficult for medium to flow around, and at least one of the part-bodies (10) can be displaced, independently of all the others (10), along the direction of the center axis of the through-flow chamber (4).

2. The device (100) as claimed in claim 1, wherein at least one of the subregions (80; 10) which it is difficult for medium to flow around is designed in such a way that its cross section, taken perpendicular to the center axis of the through-flow chamber (4) is smaller at the end of the part-body which lies closest to the entry opening (2) than at the end which lies closest to the exit opening (3).

3. The device (100) as claimed in claim 2, characterized in that at least one of the subregions (80; 10) which it is difficult for medium to flow around, is designed as a truncated cone or as a hemisphere.

4. The device (100) as claimed in claim 2, characterized in that at least one of the subregions (80; 10) which it is difficult for medium to flow around, is designed as a hollow truncated cone or as a hollow hemisphere.

5. The device (100) as claimed in claim 2, characterized in that at least one of the subregions (80; 10) which it is difficult for medium to flow around, is designed in such a way that it has a multiplicity of small elevations (88) at least in a surface subregion.

6. The device (100) as claimed in claim 5, characterized in that at least one of the subregions (80; 10) which it is difficult for medium to flow around is designed as a truncated cone with a multiplicity of small elevations (88), the small elevations each being in the form of a cone point, and the surface subregion and the arrangement of the small cone points being characterized in that the axes of symmetry of the cone points are all parallel to one another and to the direction of flow of the mass flow flowing through the through-flow chamber (4), and in that each cone point faces the mass flow flowing through the through-flow chamber (4).

7. The device (100) as claimed in one of claims 1 to 6, wherein the subregion (80; 10) which it is difficult for medium to flow around lying closest of all the subregions (80; 10) to the exit opening (3) is designed in such a way that its cross section, taken perpendicular to the center axis of the through-flow chamber (4), as seen in the direction of flow of the mass flow flowing through the through-flow chamber (4), initially increases in size and then becomes smaller and then larger again.

8. The device (100) as claimed in claim 7, characterized in that the subregion (80; 10) which it is difficult for medium to flow around lying closest of all the subregions (80; 10) to the exit opening (3) has a hollow end region (84) which faces the exit opening (3), the cross section of this hollow space (84), taken perpendicular to the center axis of the through-flow chamber (4), increasing in the direction of flow of the mass flow flowing through the through-flow chamber (4).

9. The device (100) as claimed in claim 8, characterized in that the hollow end region (84) is rotationally symmetrical, and its axis of symmetry lies parallel to the center axis of the through-flow chamber (4).

10. The device (100) as claimed in claim 9, characterized in that each cross-sectional area of the hollow end region (84) which completely includes the axis of symmetry of this region has an edge line which runs convexly, as seen in the direction of flow of the mass flow flowing through the through-flow chamber (4).

11. The device (100) as claimed in claim 9, characterized in that each cross-sectional area of the hollow end region (84) which completely includes the axis of symmetry of this region has an edge line which runs concavely, as seen in the direction of flow of the mass flow flowing through the through-flow chamber (4).

12. The device (100) as claimed in claim 1, wherein the through-flow chamber (4) is at least partially rotationally symmetrical, its center axis being the axis of symmetry, and the body (8) which it is difficult for medium to flow around is arranged in such a way that its center axis coincides with the center axis of the through-flow chamber (4).

13. The device (100) as claimed in claim 12, characterized in that the through-flow chamber (4), in its rotationally symmetrical part, has at least one bulge (20) in its wall along its circumference.

14. The device (100) as claimed in claim 13, characterized in that the body (8) which it is difficult for medium to flow around is arranged in such a way that at least one bulge (20) lies at least partially in the region of the body (8) which it is difficult for medium to flow around.

15. The device (100) as claimed in claim 13, characterized in that the body (8) which it is difficult for medium to flow around is arranged in such a way that at least one bulge (20), as seen in the direction of flow of the mass flow flowing through the through-flow chamber (4), lies immediately behind the body (8) which it is difficult for medium to flow around.

16. The device (100) as claimed in claim 1, wherein the body (8) which it is difficult for medium to flow around at least partially comprises an elastic, nonmetallic material.

17. The device (100) as claimed in claim 1, wherein the body (8) which it is difficult for medium to flow around at least in part has an elastic, nonmetallic covering.

18. The device (100) as claimed in claim 1, wherein the body (8) which it is difficult for medium to flow around has a hollow space (83) which passes all the way through it and has an inlet opening (81), which is located at that end of the body (8) which it is difficult for medium to flow around which lies closest to the entry opening (2) of the housing (1), the hollow space (83) which passes all the way through the body (8) which it is difficult for medium to flow around having at least one outlet opening (82, 85, 86), the holder (6) having a hollow space (63) which passes all the way through it and has an inlet opening (61) and an outlet opening (62), the latter being connected to the inlet opening (81) of the body (8) which it is difficult for medium to flow around; and the holder (6) and the body (8) which it is difficult for medium to flow around being connected to one another and arranged in the housing (1) in such a way that, by means of an opening (5) in the housing (1) and via the inlet opening (61) of the holder (6), part of the mass flow which is to be mixed can be introduced into the through-flow chamber (4) via the at least one outlet opening (82, 85, 86) of the body (8) which it is difficult for medium to flow around.

19. The device (100) as claimed in claim 18, characterized in that the holder (6) comprises a hollow bar which projects through the opening (5) in the housing (1), along the center axis of the through-flow chamber (4) and into the latter.

20. The device (100) as claimed in claim 18 or claim 19, wherein the hollow space which passes all the way through the body (8) which it is difficult for medium to flow around is designed in such a way that it has an outlet opening (82) which is located at that end of the body (8) which it is difficult for medium to flow around which lies closest to the exit opening (3) of the housing (1).

21. The device (100) as claimed in claim 18, wherein the hollow space which passes all the way through the body (8) which it is difficult for medium to flow around is designed in such a way that it has at least one outlet opening (85), which is located in a surface subregion of the body (8) which it is difficult for medium to flow around which at least partially faces the inner wall of the through-flow chamber (4), and which is located between two adjacent subregions (80; 10) which it is difficult for medium to flow around.

22. The device (100) as claimed in claim 18, wherein the hollow space which passes all the way through the body (8) which it is difficult for medium to flow around is designed in such a way that it has at least one outlet opening (86), which is located in a surface subregion of the body (8) which it is difficult for medium to flow around which at least partially faces the inner wall of the through-flow chamber (4), and which is located in the region of a subregion (80; 10) which it is difficult for medium to flow around.

23. The device (100) as claimed in claim 1, further comprising means for applying ultrasound to the body (8) which it is difficult for medium to flow around and/or to the mass flow at at least one location in the through-flow chamber (4).

24. The device (100) as claimed in claim 1, further comprising means for setting the body (8) which it is difficult for medium to flow around and/or part of the through-flow chamber (4) in ultrasonic vibration.

25. The device (100) as claimed in claim 1, further comprising means for applying laser light to the mass flow in the through-flow chamber (4).

26. Means (200) for mixing the components of a mass flow flowing through it, in which the components may in particular be in solid, liquid or gas form, by superimposing at least two hydrodynamic supercavitation fields, in order to generate a mixture, in particular an emulsion or suspension, wherein the means (200) has at least two devices (100) as claimed in claim 1, and a subsequent common through-flow chamber (40), the devices (100) being arranged and designed in such a way that their exit openings (3) all connect to the entry opening (30) of the subsequent common through-flow chamber (40), in such a manner that the supercavitation fields generated by the bodies (8) which it is difficult for medium to flow around spatially overlap in the entry region of the common through-flow chamber (40).

* * * * *